United States Patent [19]

Gerber

[11] Patent Number: 4,640,222

[45] Date of Patent: Feb. 3, 1987

[54] MARKING APPARATUS

[75] Inventor: Heinz J. Gerber, West Hartford, Conn.

[73] Assignee: Gerber Scientific Inc., South Windsor, Conn.

[21] Appl. No.: 739,619

[22] Filed: May 31, 1985

Related U.S. Application Data

[63] Continuation-in-part of Ser. No. 737,392, May 23, 1985, abandoned.

[51] Int. Cl.[4] ..... B05C 5/02

[52] U.S. Cl. ..... 118/697; 118/704; 118/608; 118/37; 118/308; 118/323

[58] Field of Search ..... 118/704, 608, 37, 308, 118/697, 323

[56] References Cited

U.S. PATENT DOCUMENTS

| | | | |
|---|---|---|---|
| 2,532,298 | 12/1950 | Goldstein | 118/308 |
| 3,827,394 | 8/1974 | Takahashi et al. | 118/308 |
| 3,909,831 | 9/1975 | Marchio et al. | 118/697 |
| 3,917,170 | 11/1975 | Marino | 118/317 |
| 4,018,185 | 4/1977 | Myers | 118/308 |
| 4,020,789 | 5/1977 | Gamurellis | 118/308 |
| 4,364,330 | 12/1982 | Pearl | 118/697 |
| 4,493,859 | 1/1985 | Krantz | 118/308 |
| 4,535,001 | 8/1985 | Greener | 118/308 |

FOREIGN PATENT DOCUMENTS

| | | | |
|---|---|---|---|
| 1562484 | 4/1969 | France | 118/308 |

*Primary Examiner*—Shrive P. Beck

*Attorney, Agent, or Firm*—McCormick, Paulding & Huber

[57] ABSTRACT

An apparatus for annotating a workpiece with powder comprises a writing device which outputs a stream of powder and a mechanism such as an X-Y plotter for moving the device and the workpiece relative to one another to shape the annotation. One such writing device comprises a grinding wheel which grinds powder from a stick of chalk, a nozzle aimed at the workpiece, and air moving means for entraining the powder and transporting it through the nozzle. Another such writing device comprises a storage means for the powder, the storage means tapering to form a downwardly sloping guide which collects powder and leads to an outlet, and a gear adjacent the guide having teeth which move the powder along the guide towards the outlet. Both the rate of powder grinding by the first device and the rotational speed of the gear in the latter device are variable in proportion to the writing speed to adjust the output of powder and thereby provide an annotation of generally uniform intensity despite variations in writing speed.

26 Claims, 16 Drawing Figures

MARKING APPARATUS

BACKGROUND OF THE INVENTION

This is a continuation in part of pending U.S. patent application entitled "Marking Apparatus", by Heinz Joseph Gerber, Ser. No. 737,392, filed May 23, 1985 now abandoned.

The invention relates generally to marking apparatuses and deals more particularly with a marking apparatus having a marking device which apparatus operates by causing the marking device to dispense a stream of powder on a workpiece as it moves the workpiece and the marking device relative to one another.

The invention has various applications, for example, in the garment making industry to annotate pattern pieces cut from sheets of fabric, which pattern pieces are later sewn into garments and the garments subsequently cleaned to remove the annotations. The pattern pieces are typically cut by an automatic cloth cutting apparatus, such as that shown in U.S. Pat. No. 4,091,701 to Pearl, issued May 30, 1978 assigned to the assignee of the present invention and hereby incorporated by reference as part of the present disclosure. The patented apparatus includes a table having a work surface for supporting a single worksheet or a layup of worksheets, a cutting device movable in a plane generally parallel to the work surface to cut the pattern pieces, and a computer to direct the movement of the cutting device and the timing of the cutting.

A wide variety of pattern pieces may be cut from a worksheet and the pieces have numerous possible destinations and uses, so it is desirable to annotate the pattern pieces to provide such information.

Heretofore, pattern pieces have been annotated automatically by label applicators such as that disclosed in U.S. Pat. No. 4,028,167 to Gerber and by needle and dye thread assemblies such as that disclosed in U.S. Pat. No. 3,991,706 to Pearl, and manually by an operator writing with a piece of chalk directly on pattern pieces or by an operator writing with ink on labels and manually affixing them to pattern pieces. Both of the manual annotating systems are costly and subject to error. It is also cumbersome to write manually with a stick of chalk on a soft pattern piece because the pattern piece tends to deform when contacted by the chalk stick. Also, when annotations are written manually with chalk, some of the applied chalk penetrates deeply into the pattern piece because of the writing force and it is difficult to remove it later from the finished product. Because of similar problems with annotation removal and with the mechanics of marking on a soft pattern piece, it is not suitable to inscribe such annotations with a conventional plotting device utilizing a pen, a pencil or an ink jet head such as those disclosed in U.S. Pat. No. 4,421,783 to Gerber et al or No. 4,26,285 to Pearl.

Accordingly, a general aim of the invention is to provide a marking apparatus having a marking device which annotates a workpiece with a removable substance.

Another aim of the invention is to provide a marking apparatus of the foregoing type in which the marking is controlled by a computer.

A more specific aim of the invention is to provide a marking device of the foregoing type which cooperates with an automatic cutting apparatus to annotate pattern pieces cut by the cutting apparatus.

Another specific aim of the invention is to provide a marking device of the foregoing type which includes means for controlling the marking intensity.

Another specific aim of the invention is to provide a marking device which marks a workpiece by dispensing powder on the workpiece and includes means for preventing the powder from caking excessively within the marking device.

Other aims of the invention will become apparent from the following detailed description and drawings.

SUMMARY OF THE INVENTION

The invention resides in a marking apparatus having a marking device which annotates a pattern piece by dispensing a stream of powder as the marking device and pattern piece are automatically moved relative to one another. According to one feature of the invention, the marking apparatus is combined in cooperative relation with an automatic cutting apparatus to annotate pattern pieces cut by the apparatus. According to another feature of the invention, the marking apparatus includes means for adjusting the rate at which powder is dispensed in relation to the marking speed to provide control over the marking intensity. Various means are provided to dispense the powder; one such means comprises a housing to store powder, a downwardly sloping guide located beneath the store of powder which guide leads to an outlet, and a mechanism for automatically agitating the store of powder to cause the powder to flow uninterruptedly to the guide. Another such means to dispense the powder comprises means for grinding powder from its solid form, a nozzle, and air moving means for entraining the powder and transporting it through the nozzle. Another such means to dispense the powder comprises means for grinding powder from its solid form and a flexible member which engages the grinding means to dislodge powder which cakes on the grinding means and allow it to pass to an outlet.

BRIEF DESCRIPTION OF THE FIGURES

FIG. 12 is a perspective, schematic view of another marking device embodying the present invention.

FIG. 13 is a fragmentary, end view of the marking device of FIG. 12.

FIG. 14 is a fragmentary, side view of the marking device of FIG. 12.

FIG. 15 is a fragmentary view of a base, block portion and flexible cleaning member of the marking device of FIG. 12.

FIG. 16 is a fragmentary, schematic view of another working device embodying the present invention.

DETAILED DESCRIPTION OF THE PREFERRED EMBODIMENTS

Figure 1:
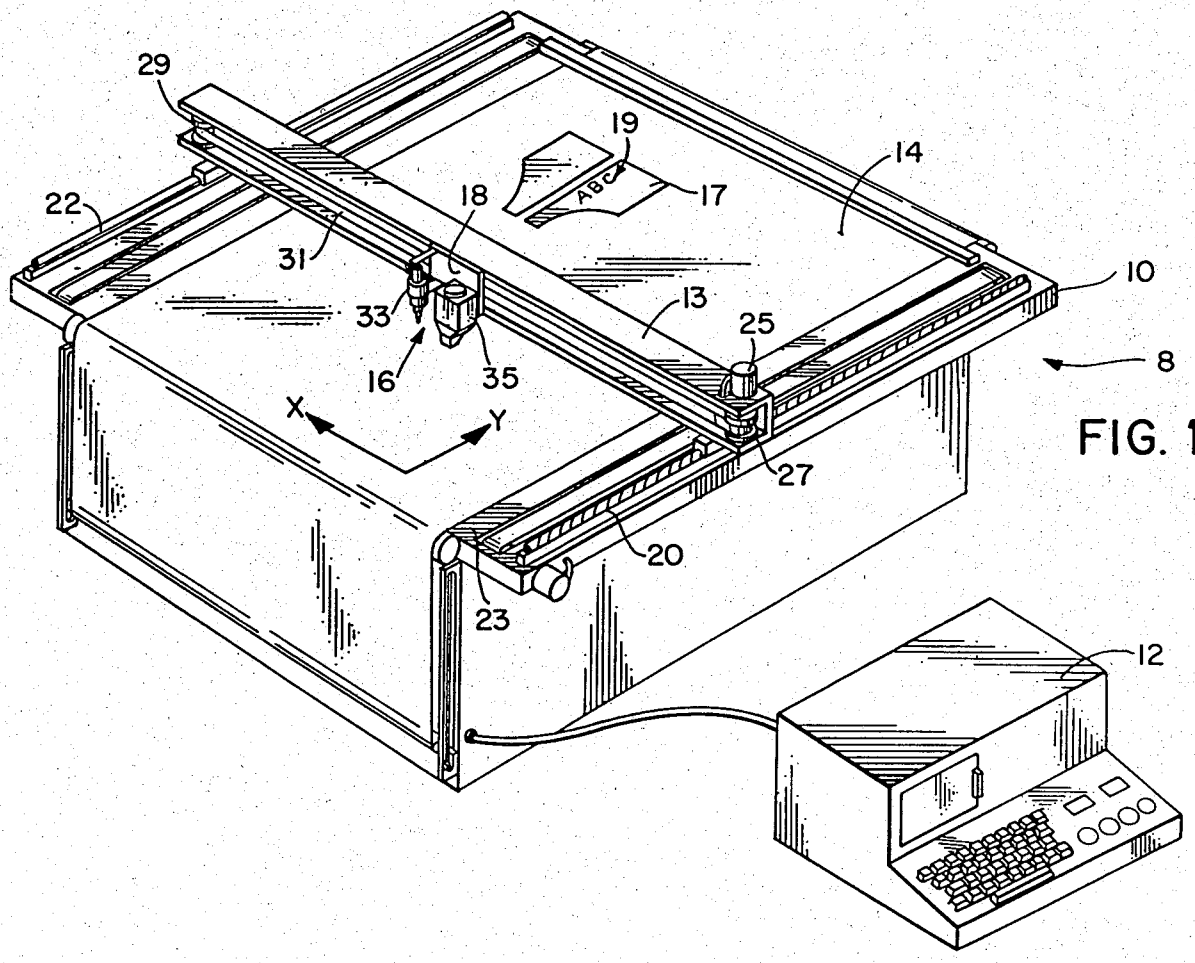
FIG. 1 is a perspective view of an automatic cutting and marking apparatus in which the invention is embodied.

FIG. 1 illustrates an automatic cutting and marking apparatus generally designated 8 in which the invention is embodied. The apparatus 8 includes a table 10 which supports a worksheet 14 and a cutting and marking head 16 which is supported above the table for movement in a plane generally parallel thereto. The head is movable in an illustrated Y-coordinate direction by a drive system including a sliding bridge 13, a lead screw 20 threadably received by the bridge, a guide bar 22 which supports the bridge and a Y-direction, stepping motor 27 for turning the lead screw. The head 16 is also movable in an illustrated X-coordinate direction by means of a drive system including a carriage 18 which supports the head 16, an X-direction, stepping motor 25, a motor pulley 27 driven by the motor 25, a pulley 29, and a timing belt 31 supported between the pulleys 27 and 29, which belt is attached to the rear of the carriage 18 for moving it.

Both drive motors are controlled by a controller 12 which includes a computer. The computer receives its instructions from a program tape, which instructions provide such information as the shapes of the desired pattern piece to be cut and alphanumeric characters or other inscriptions to be annotated on the pattern piece. Based on this information the computer directs the X-Y motors during one time period to move the head 16 along a cutting route which outlines the shape of the desired pattern piece and activates a cutting device 33 within the head to cut it; and during another time period, the computer directs the X-Y motors to move the head 16 along a route which outlines the shape of the desired annotation and activates a marking device 35 within the head to mark it. For a further description of an apparatus capable of moving a head such as the head 16 along a desired cutting or plotting route in a plane parallel to a work surface, reference may be made to U.S. Pat. No. 3,529,084 to Rich, issued on Sept. 15, 1970, assigned to the assignee of the present invention and hereby incorporated by reference as part of the present disclosure.

The cutting device 33 is a conventional type such as that disclosed in U.S. Pat. No. 4,294,047 to Pearl issued Oct. 13, 1981, assigned to the assignee of the present invention and hereby adopted by references as part of the present disclosure. It includes a reciprocating knife blade which is suspended in a cantilevered fashion at its upper end and is rotatable under the influence of a control drive motor (not shown) about a theta axis coincident with the leading cutting edge of the blade to maintain the blade tangent to the line of cut. The table 10 includes a bed 23 typically made of bristle blocks or foam which bed is penetrated by the knife blade as it cuts a pattern piece.

FIG. 1 also illustrates a pattern piece 17 having an annotation 19 which pattern piece was cut from the worksheet 14 by the cutting device 33 and annotated by the marking device 35.

FIGS. 2 through 5 further illustrate the marking device 35 which includes a housing 40 for storing powdered chalk or other powder which housing tapers at its lower end into a downwardly sloping guide portion 42 leading to an outlet 44. The outlet is small, for example a $\frac{1}{8}$ inch diameter hole, and yields a thin stream of powder. The marking device also includes a gear 46 (FIG. 2) which controllably delivers the powdered chalk to the outlet, a gear mechanism 50 (FIG. 3) which agitates the store of chalk to break it up and thereby prevents it from bridging and causes it to flow uninterruptedly to the guide 42 and to the delivery gear 46. A motor 48 (FIG. 4) drives the gear 46, which motor is controlled by the controller 12 via wires 49,49.

Figure 3:
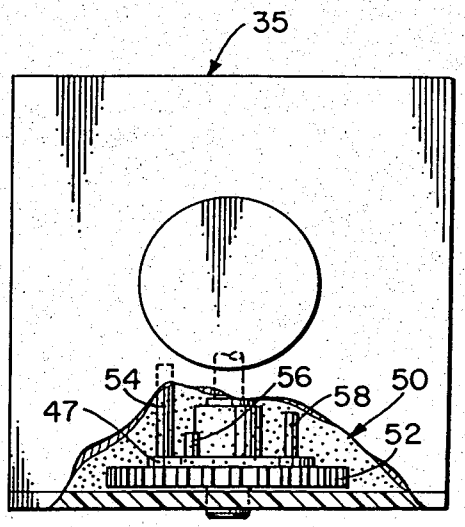
FIG. 3 is a top view, partially broken away, of the marking device of FIG. 2.
Figure 2:
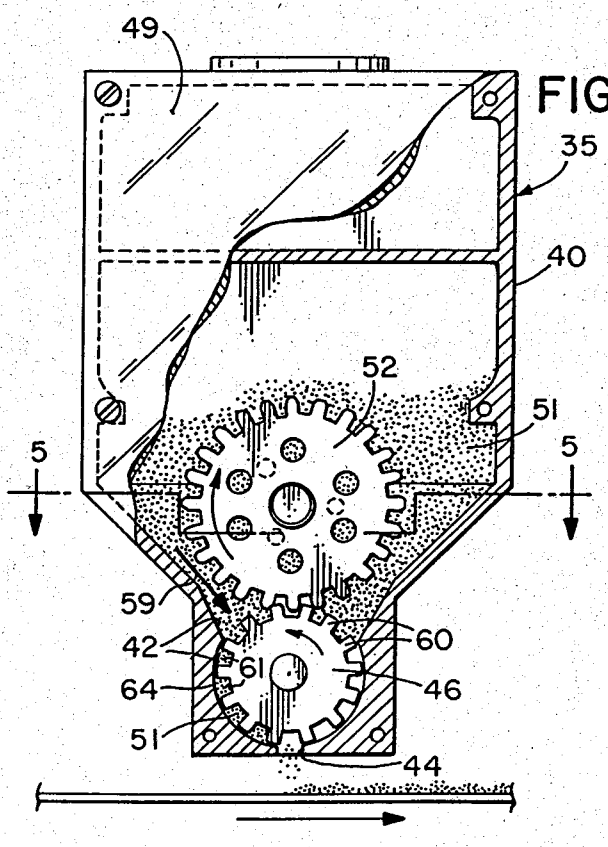
FIG. 2 is a front view, partially broken away, of a marking device of the apparatus of FIG. 1 which device embodies the present invention.
Figure 5:
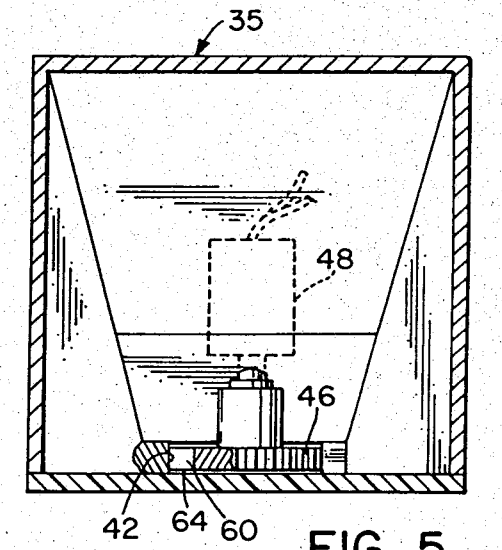
FIG. 5 is a sectional view taken along the plane 5—5 of FIG. 2.
Figure 4:
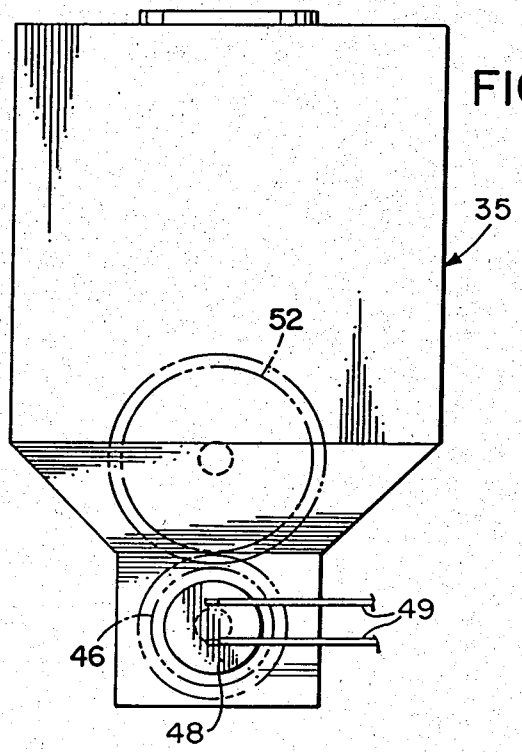
FIG. 4 is a rear view of the marking device of FIG. 2.

As shown in FIGS. 2 and 3, the gear mechanism 50 comprises a gear 52 which meshes with and is driven by the gear 46, and stirring rods 54, 56 and 58 of varying lengths which rods extend generally parallel to the axis of the gear 52 and are attached to a support wheel 47 which wheel is fixedly attached to the rear of the gear 52. When the housing is loaded with powder chalk 51, the stirring rods penetrate the store of chalk and when the marking device is activated, the stirring rods revolve around the axis of the gear 52 and stir and in other ways agitate the chalk so that it falls freely by gravity onto the guide 42, some of which chalk flows along a course indicated by an arrow 59.

When the chalk reaches the gear 46 by this course or otherwise, it falls into interstices 61,61 between teeth 60,60 of the gear 46 and is propelled by the teeth in the direction of gear rotation. In the illustrated embodiment, the gear 46 rotates counter-clockwise and moves chalk downwardly into a guide channel portion 64 of the guide 42 which channel portion is defined by a base of the housing, the gear 46 and a front plate 49 of the housing. The length of each tooth 60 is nearly equal to the depth of the channel and the thickness of each tooth is nearly equal to the width of the channel so that each tooth within the channel acts as a movable barrier and, together with the housing forms enclosed pockets between each pair of adjacent teeth which pockets are filled with the chalk powder 51. As the gear 46 turns further, the teeth 60,60 transport the pockets of powder downwardly towards the outlet 44 and as each tooth passes over the outlet, the rearwardly adjacent pocket opens up and the powdered chalk within spills through the outlet. The marking device 35 is suspended slightly above the pattern piece, for example $\frac{1}{4}$ inch, so the chalk therefore spills onto the pattern piece as a stream making a mark.

Figure 6:
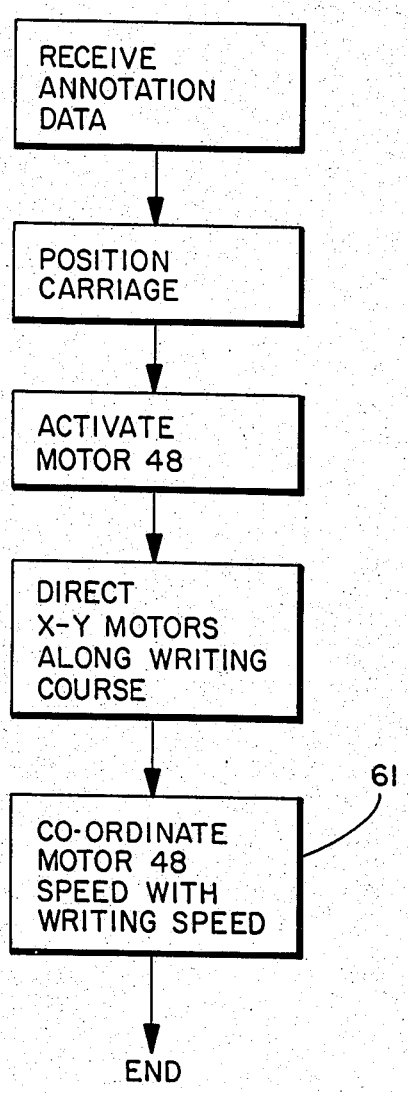
FIG. 6 is a flow chart illustrating a computer program for controlling the marking intensity of the marking device of FIG. 2.

A flow chart shown in FIG. 6 illustrates a computer program to produce an inscription such as the annotation 19 on the pattern piece 17. First, an operator feeds data defining the desired annotation into the computer, and from that data, the computer later directs the X-Y motors to position the carriage 18 over a starting point of the annotation. Then the computer activates the motor 48 causing the marking instrument 35 to begin to spill powdered chalk, and simultaneously directs the X-Y motors to move the carriage along a route which outlines the desired characters of the annotation so that the stream of chalk forms the annotation. The inscription may have a somewhat beaded appearance due to the manner in which the powder is delivered to the outlet 44. As indicated by a step or process 61, the rate of powder delivery is coordinated with the marking speed.

Both for aesthetic purposes and practical ones, it is desirable to produce an inscription having a moderate and substantially uniform intensity. A light inscription is hard to see and an excessively heavy inscription or portion thereof is liable to smudge, blurring the inscription and unnecessarily soiling the worksheet.

The intensity of the inscribed characters or portions thereof depends on the rate at which the powdered chalk spills through the outlet 44 and the speed at which the marking instrument 35 moves relative to the worksheet, and the rate of chalk spillage depends on the number of pockets of powdered chalk which pass over the outlet 44 per unit time and spill their contents. Hence, to control the marking intensity, the computer directs the motor 48 to spin the gear 46 at a rate proportional to the speed that the instrument 35 moves in the X-Y plane relative to the worksheet, i.e. the marking speed. However, the output need not be precisely controlled because the annotations are removed prior to the sale of the finished product, and it should be understood that there are other ways to vary the output of powder in relation to the marking speed so that the output of powder at a high marking speed is high and the output at a low marking speed is low.

Figure 7:
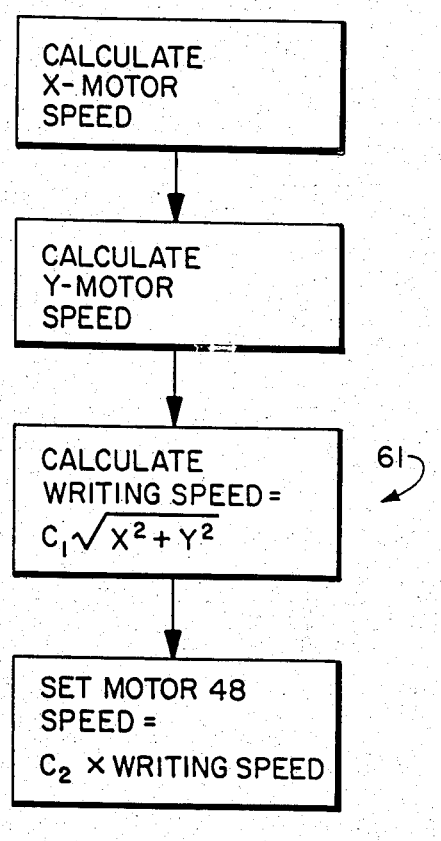
FIG. 7 is a flow chart further illustrating one step of the flow chart of FIG. 6.

A flow chart shown in FIG. 7 further illustrates the process 61 of varying the rate of powder delivery in proportion to the marking speed, which process 61 may be performed by software and/or hardware. First, the X-motor and Y-motor speeds are calculated by sensing the number and rate of pulses sent to the respective stepping motors. Then the speed of the carriage and the marking device 35 is calculated from Pythagorian's Theorem and a suitable multiplying constant $C_1$ to determine the marking speed. Next, the controller 12 adjusts the speed of the motor 48 to a level approximately equal to a constant $C_2$ times the marking speed calculated above. The process 61 is repeated frequently if performed by software and continuously if performed by hardware.

To halt the writing, either at the completion of the annotation, between characters within the annotation or between discontinuous portions within a character, the computer simply halts the motor 48 causing the teeth 60,60 within the guide channel 64 to trap the powdered chalk within the associated pockets and thereby block the channel and prevent further delivery of chalk to the outlet 44.

Figure 8:
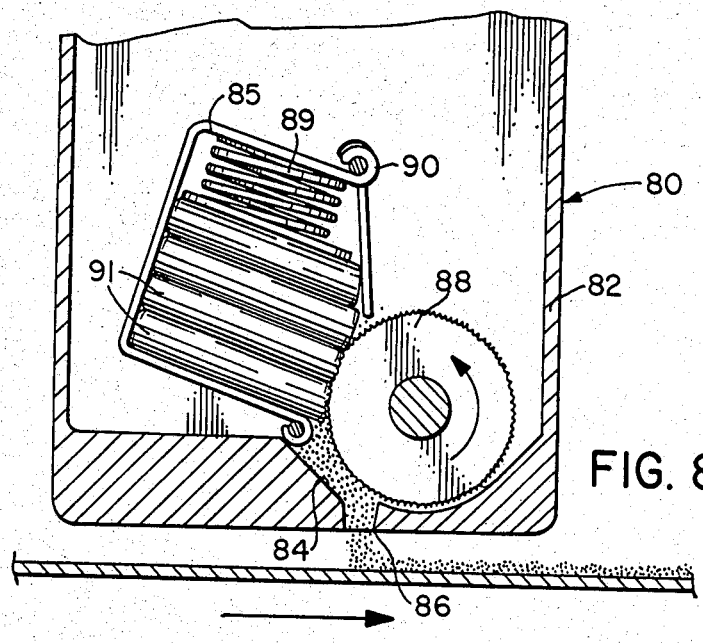
FIG. 8 is a schematic view of another marking device embodying the present invention.

FIG. 8 illustrates a marking device generally designated 80 comprising another embodiment of the invention. The marking device 80 may be mounted to the carriage 18 of the apparatus 8 in place of the marking device 35 in which case the device 80 is controlled by the controller 12. The marking device 80 comprises a housing 82 having a downwardly sloped guide chute 84 leading to an outlet 86, a grinding wheel 88 rotatably mounted to the housing 82 adjacent the guide 84 with its axis horizontal, and a chalk stick dispenser 85 comprising springs 89 and 90 for urging sticks 91,91 of chalk against the grinding wheel at a generally continuous force. The marking device 80 further includes a DC motor (not shown) controlled by the controller 12 which motor drives the grinding wheel 88.

To operate the marking device 80, the grinding wheel 88 is rotated in the counterclockwise direction to grind powder from the bottom chalk sticks 91,91 and deliver the powder in an agitated state to the guide chute 84. The powder slides down the guide chute and spills through the outlet 86 onto the worksheet below. In a manner analogous to the movement of the marking device 35 along a course which outlines the desired characters, the marking device 80 is so moved in the X-Y plane as the powdered chalk falls through the outlet to form the desired characters or other symbols. The outlet is small, for example, a $\frac{1}{8}$ inch diameter hole so reasonably thin lines are produced.

The speed of the grinding wheel and so the production of powder and output through the outlet is coordinated with the marking speed, for example, in a generally proportional relation to produce an annotation of generally-uniform intensity. In addition to being generally uniform in intensity, lines produced by the marking device 80 are continuous because powder is delivered to the guide chute 84 continuously. To halt the output of powder, either after an annotation is completed or between or within alphanumeric symbols as needed to form the annotations, the controller directs the grinding wheel motor to halt. An instant later, the guide chute 84 empties of powder and the output ceases.

Figure 9:
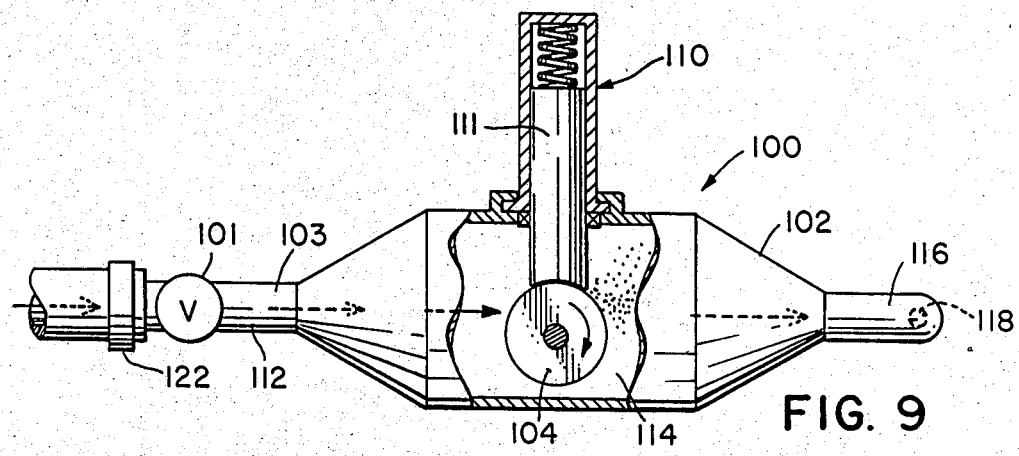
FIG. 9 is a top, schematic view of another marking device embodying the present invention.
Figure 10:
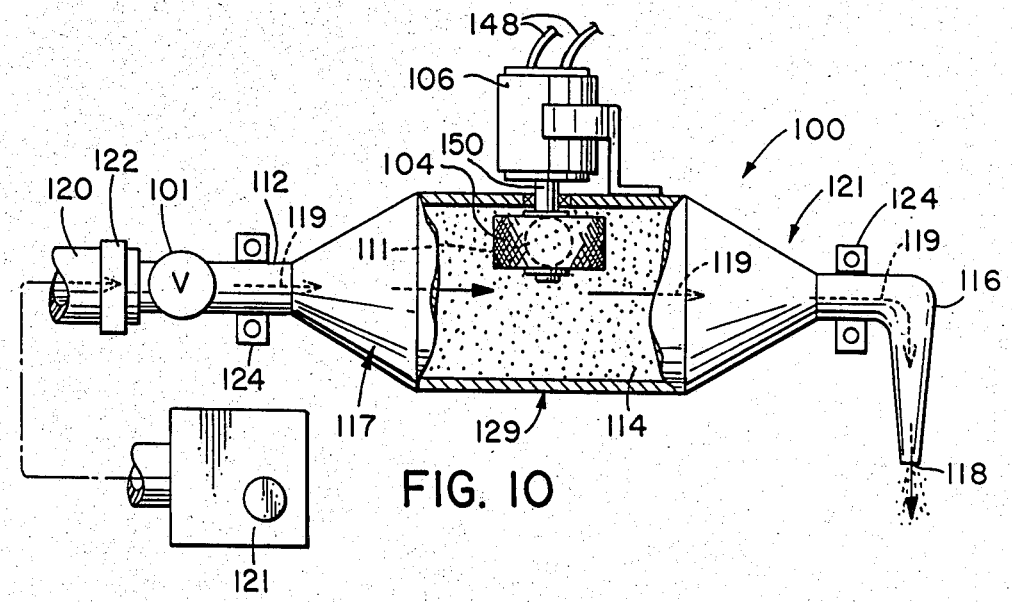
FIG. 10 is a side view of FIG. 9.

FIGS. 9 and 10 illustrate another marking device generally designated 100 comprising another embodiment of the invention. The marking device may be mounted to the carriage 18 as a substitute for the marking device 35 and be controlled by the X-Y motors and the controller 12. The marking device 100 comprises a housing 102, an intake tube 112 leading to the housing, a solenoid valve 101 mounted within the intake tube, a grinding wheel 104 mounted for rotation within the housing with its axis vertical, a DC motor 106 which drives the grinding wheel, a spring loaded support mechanism 110 for feeding a stick of chalk at a generally constant force to the grinding wheel and a guide or output nozzle 116 leading to an outlet 118. The housing comprises main body portion 119 defining a grinding plenum or chamber 114 and is assembled by mating an intake portion 117 to the main body portion 119 and the main body portion to an output portion 121 with force-fit or threaded connectors. A hose 120 leads from an air pump 121 to the intake tube and is connected with a clamp 122. Brackets 124,124 connect the marking device 100 to the carriage 18 with the outlet 118 approximately $\frac{1}{4}$ inch above the worksheet.

The controller 12 communicates with the motor 106 via wires 148,148 and the motor turns the grinding wheel 104 with a shaft 150 guided by a roller bearing 152 mounted within the main body portion of the housing 102.

To operate the marking device 100, the controller activates the motor 106 to rotate the grinding wheel causing the grinding wheel to grind powder from the chalk stick 142, which powder is dispersed within the grinding chamber 114. Simultaneously, the control 12 opens the valve 101 to allow pressurized air to flow through the intake tube 112, the grinding chamber 114, the nozzle or guide 116 and the outlet 118 as indicated schematically by arrows 119,119. This air entrains much of the freshly-ground powder and some of the previously ground powder which fell to the bottom of the chamber 114 and carries it in an airstream through the outlet 118 and onto the worksheet. The level of air pressure should be adjusted such that the pressurized air carries sufficient quantities of powder through the outlet but is not so great that it excessively drives the powder into the worksheet making it difficult to remove later on.

To form alphanumeric characters or other inscriptions, the marking device 100 is moved in the X-Y plane relative to the worksheet as discussed above and to de-activate the marking instrument 100 and thereby cause it to stop writing, the valve 101 is closed and the grinding wheel 104 halted. To produce a generally uniform marking intensity, the speed of the grinding wheel is coordinated with the marking speed. By way of example, the rotational speed of the grinding wheel may be maintained approximately proportional to the marking speed in a manner analogous to that depicted in the flowchart of FIGS. 6 and 7. On occasion, the housing 102 may be disassembled for cleaning purposes.

Figure 11:
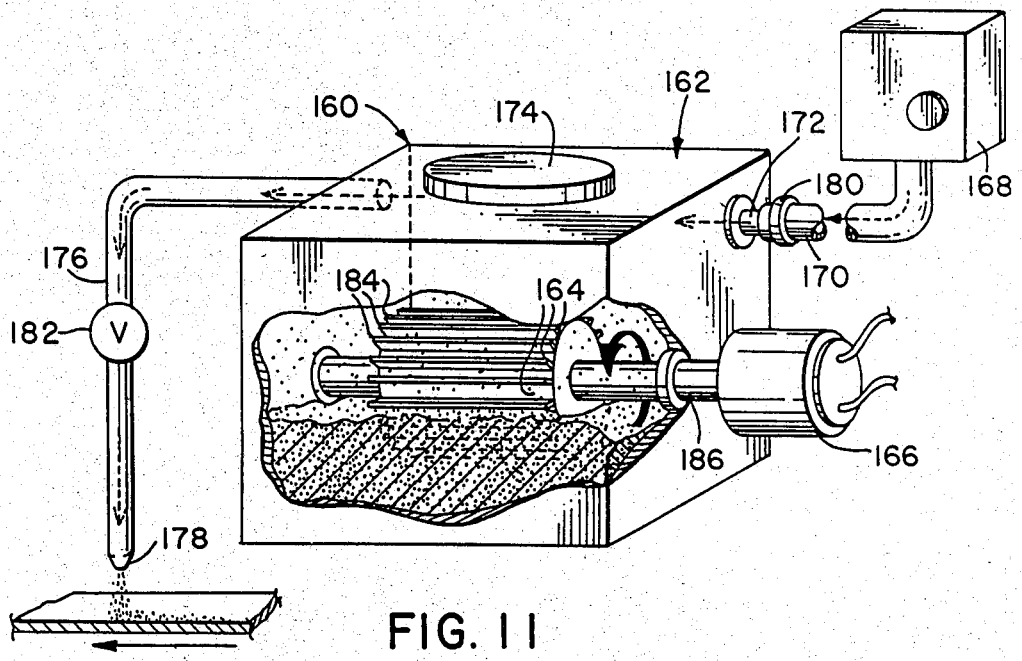
FIG. 11 is a schematic view of another marking device embodying the present invention.

FIG. 11 illustrates a marking device generally designated 160 comprising another embodiment of the invention. The marking device comprises a housing 162, an intake tube 170 leading to the housing, a drum 164 mounted for rotation within the housing with its axis horizontal, a DC motor 166 which drives the drum, an air pump and regulator 168 and a hose 170 coupling the air pump to the intake tube. The housing comprises a main body portion 174 for storing powdered chalk, and a guide or nozzle 176 leading to a small outlet 178. The marking device 160 may be mounted to the carriage 18 in place of the marking device 35 and be controlled by the controller 12 and, in such a case, the marking device is mounted such that the outlet 178 is approximately ¼ inch above the worksheet. The hose 170 is attached to the intake tube with a clamp 180, and a solenoid controlled valve 182 governs air flow through the nozzle 176. The drum 164 has ridges 184,184 on its outer surface parallel to the drum axis, and the motor 166 directly drives the drum via shaft 186. Both the opening and the closing of the valve 182 and the activation and speed of the motor 166 are controlled by the controller 12.

To operate the marking device 160, the main body 174 is filled with powdered chalk approximately to the level of the axis of the drum and then, the drum is rotated at a speed coordinated with the marking speed. The drum rotation causes the ridges to agitate the powdered chalk in "paddle-wheel" fashion to an extent sufficient to drive some of the powdered chalk into temporary suspension in the air space above the drum. Simultaneously, the valve 182 is opened and pressurized air flows from the air pump 168, through the hose 170, the intake tube 172, the air space within the main body 174, the guide nozzle 176 and the outlet 178. The pressurized air entrains powdered chalk from the air space within the main body and carries it as a stream out the nozzle and against the worksheet where much of it is deposited forming a chalk mark. The marking apparatus 160 is moved along a course in the X-Y plane outlining the desired inscription, and the output of powdered chalk onto the worksheet is coordinated with the marking speed to provide a generally uniform line intensity. By way of example, the speed of the drum 164 may be maintained proportional to the marking speed, and the diameter of the outlet is ⅛ inch.

FIGS. 12–15 illustrate a marking device generally designated 200 comprising another embodiment of the invention, which device may be mounted to the carriage 18 in place of the marking device 35 and controlled by the controller 12. As shown in FIG. 12, the marking device 200 comprises a housing 202, a motor 204 fixedly attached to the housing, a grinding wheel 206 driven directly by the motor 204 and supported within the housing with its axis horizontal, a chalk stick dispenser 208 for feeding a stick 212 of chalk to the grinding wheel, and a frame 210 which supports the dispenser 208 on top of the housing 202. The housing 202 includes an access hole 203 to service the marking device, which hole 203 is plugged when the device is in use.

The chalk stick dispenser 208 comprises a sleeve portion 218 which loosely receives the chalk stick 212, a cap 220 fixedly secured to the upper end of the sleeve 218, and a helical spring 214 braced at its toy end against the cap 220. The bottom end of the spring 214 engages the chalk stick 212 to force it against the grinding wheel 206. By way of example, the spring 214 condition is twelve inches long in its relaxed condition and the chalk stick is initially twelve inches long and ground to progressively shorter lengths. The force of the spring together with the weight of the chalk constitute the grinding force. Because the spring is much longer than the stick of chalk, the force applied by the spring on the chalk is relatively constant regardless of the length of the chalk stick remaining. Also, the force (for example, two ounces) applied by the spring is larger than the initial weight of the chalk stick so that the grinding force does not vary excessively as the chalk stick is consumed.

In the illustrated embodiment, the support frame 210 for the chalk dispenser, is two tiered and comprises plates 222 and 224 having apertures 226 and 228, respectively, to receive and guide the sleeve 218. Rods 230, 230 are fixedly mounted to the housing 202, extend vertically upward and are fixedly received by the plates 222 and 224 to support them.

As shown more clearly in FIGS. 13 and 14, the grinding wheel 206 has a grinding surface comprising teeth in the form of longitudinal splines or burrs 232, 232 which splines engage the chalk stick 212. Each of the splines 232 has a triangular cross-section and the exposed sides of the splines intersect at 90 degree angles.

As shown in FIG. 15, the wire 236 formed from a single strand of flexible music or spring wire bent into a tongue portion 240, a root portion 242 and an anchor portion 243, and further includes a cleaning wire 238 formed from a single strand of such flexible music or spring wire bent into a tongue portion 244, a root portion 246, and an anchor portion 248. The wires 236 and 238 are mounted within a block portion 250 of the housing 202, which block portion includes a horizontal groove 252 disposed in the direction of the grinding wheel 206 and vertical bores 254 and 256. The depth of the groove approximately equals the diameter of the wires 236 and 238, and the width of the groove is approximately equal to twice the diameter so that the root portions 242 and 246 are snugly received, side-by-side, within the groove 252. The anchor portions 243 and 248 are snugly received within the bores 254 and 256, respectively. When installed, the block portion 250 is fixedly and flushly secured to the underside of the remainder of the housing 202 by screws (not shown) which pass through bores 260,260. Because of the anchor portions, the root portions of the wires 236 and 238 cannot rotate within the housing 202. The tongue portions 240 and 244 extend upwardly, sometimes engaging the splines 232, which bend them and sometimes resting vertically within the valleys 231,231, depending on the angular orientation of the grinding wheel 206.

As the motor 204 rotates the wheel 206, the wheel grinds powder 221 from the chalk stick 226, some of which powder indicated as a falls freely to an outlet 234 at the bottom of the housing; and if the marking device 200 is supported on the carriage 18, this powder indicated as b makes a mark on the workpiece 14. Some of the powder ground by the wheel 206 also collects or cakes temporarily in valleys 231,231 between the splines 232, 232 and is temporarily carried by the wheel as the wheel rotates. The tongue portions extend well into the valleys 231, 231; and as the grinding wheel 206 rotates, the tongue portions flicker across the splines 232, 232 passing into and out of the valleys 231, 231. Because of the angular shape of the splines, the tongues scrape along the sides of the splines as the wheel rotates and thereby scrape much of the powder **221*b* from the valleys of the grinding wheel. The tongue portions 240 and 244 are slightly staggered laterally in relation to the axes of the wheel 206 due to their side-by-side mounting within the groove 252 and so, flicker across the splines in a slightly staggered fashion. This staggering may help to break up the chalk which is caked within the valleys and thereby facilitate the dislodging of it. The dislodged powder 221*b* falls from the wheel and joins with the powder 221*a* which falls freely from the grinding wheel to contribute to the mark on the workpiece 14**.

To lessen the amount of caking in the first place and to improve the performance of the cleaning wires, it is helpful to use a non-greasy type of chalk stick such as that sold under the name Avalon "NU-CHALK", Model No. 7720. Also, to form legible annotations, it is helpful to provide relatively thin lines and to this end, the grinding wheel 206 has an outer diameter of 0.4 inches, ridge tip to ridge tip, and a length of 0.5 inch, and the outlet is slightly larger than the horizontal cross-section of the grinding wheel taken through its axis.

The marking device 200 is moved on the carriage 18 in the X-Y plane in the same manner that the marking device is moved along a course which outlines a desired annotation to inscribe the annotation. To provide a generally uniform marking intensity, the speed of the motor 204 and so that the rate of grinding and output the of powder is controlled by the controller 12. By way of example, the rotational speed of the grinding wheel is maintained approximately proportional to the marking speed in a manner analogous to that depicted in the flowcharts of FIGS. 6 and 7.

FIG. 16 illustrates a portion of a marking device generally designated 300 comprising another embodiment of the invention. The marking device 300 is identical to the marking device 200 except that the marking device 300 includes a washer shaped cap 302 and a barbed ripple fitting 304 instead of the cap 220. The fitting 304 receives a hose 310 which hose passes pressurized air from a suitable source 312.

The controller 12 operates a valve 314 adjacent the source 312 to control the flow of pressurized air, which pressurized air flows through the sleeve 218, adjacent the grinding wheel and out the outlet 234 to clear the grinding wheel and housing 202 of residual powder and facilitate and make more continuous the output of powder.

By the foregoing, marking devices for annotating a workpiece with powdered chalk or other powder have been described. However, numerous modifications and substitutions may be made without deviating from the scope of the invention. For example, a movable trap door activated by a solenoid and controlled by the controller 12 may be installed at each outlet of the aforesaid marking devices and closed when the computer program calls for a halt to the writing to hasten the curtailment of marking.

Also if desired, a tapered outlet may substitute for the outlet 234 of the marking device 200 or 300 so that the powder ground from the chalk stick is condensed to provide thinner lines. Also, if desired, the wires 226 and 228 may be supported such that both tongue portions lie in a common plane which passes through the axes of the grinding wheel and so, engage the peaks of the splines and the depths of the valleys of the grinding wheel at precisely the same time. Alternately, the wires 236 and 238 may be supported higher in the housing 202 so that the tongues engage the grinding wheel 206 from the side. It is also possible to use a conventional constant force spring comprising a curled strip of flexible material instead of the spring 214 in which case the height of the marking device 200 may be reduced without sacrificing consistency in the grinding force.

In addition, the output of powder from the marking devices 80 and 100, if desired, may be varied by controlling the force at which the chalk sticks are urged against the respective grinding wheels; the greater the force, the greater the output of powdered chalk. Also, if desired, the motors 48, 106 or 166 or the motor driving the grinding wheel 88 may have their speeds variable in relation to the marking speed such that the motors are operable at only discrete levels, one of which being selected by the controller for a pre-determined range of marking speeds. Therefore, the invention has been disclosed by way of illustration and not limitation.

I claim:

1. An apparatus for cutting and annotating porous sheet material, said apparatus comprising:

means defining a support surface for supporting said sheet material, marking means for outputting a stream of powder downwardly onto said sheet material to mark it, said marking means comprising a movable mechanical element which engages said powder and urges it into air to minimize the force necessary to deliver said powder to said sheet material, means for supporting said cutting means and said marking means adjacent to said support surface and for automatically moving said marking means and said support surface in relation to each other along a first course which outlines said annotation as said marking means outputs a stream of powder and moving said cutting means and said support surface in relation to each other along a second course which outlines a pattern piece as said cutting means cuts out said pattern piece, and means for adjusting the output of said stream of powder in relation to a marking speed to regulate marking intensity.

2. An apparatus as set forth in claim 1 wherein said means for adjusting the output of said stream of powder comprises means for automatically adjusting the output of said stream of powder in proportion to changes in the marking speed.

3. An apparatus for cutting and annotating porous sheet material, said apparatus comprising:

means defining a support surface for supporting said sheet material, marking means for outputing a stream of powder downwardly onto said sheet material to mark it, said marking means comprising means to deliver said powder to said sheet material, and means for supporting said cutting means and said marking means adjacent to said support surface and for automatically moving said marking means and said support surface in relation to each other along a first course which outlines said annotation as said marking means outputs a stream of powder and moving said cutting means and said support surface in relation to each other along a second course which outlines a pattern piece as said cutting means cuts out said pattern piece, said marking means including means for grinding powder from its solid form and directly dispensing said powder by gravity through an outlet to said sheet material, said means for grinding comprising said movable mechanical element.

4. An apparatus as set forth in claim 3 wherein said means for outputting a stream of powder comprises grinding means for grinding powder from its solid form, said grinding means including a grinding surface, engaging means for dislodging powder from said grinding means, said engaging means including a flexible member which engages said grinding surface as said grinding means grinds said powder.

5. An apparatus as set forth in claim 4 wherein said grinding means comprises a grinding wheel having teeth and a means for rotating said wheel, and wherein said engaging means comprises a flexible wire which engages said teeth as said wheel rotates to remove powder from said wheel.

6. A marking apparatus for annotating a porous, fabric worksheet, said marking apparatus comprising:

means defining a support surface for supporting said worksheet, means for outputting a stream of powder onto said worksheet including moveable mechanical means for engaging said powder and urging it into air to minimize the force necessary to deposit said powder on said worksheet, and means for automatically varying the output of powder in relation to variations in marking speed to regulate marking intensity and means for automatically moving the output means and said support surface relative to one another along a programmed route defining the shape of said annotation.

7. A marking apparatus as set forth in claim 6 wherein said means for automatically varying the output of powder comprises means for varying the output approximately in proportion to said variations in marking speed.

8. A marking device as set forth in claim 6 wherein said means for outputting said powder includes an outlet which is less than one half inch across its widest portion.

9. A marking device as set forth in claim 6 wherein said moveable mechanical element takes the form of a grinding wheel, said powder moves predominantly by gravity from said grinding wheel to said worksheet, and said means for automatically varying the output of powder includes means for varying the grinding rate in relation to variations in marking speed.

10. A marking device as set forth in claim 6 wherein said means for outputting a stream of powder further comprises air moving means for entraining the ground powder which was urged into said air and carrying it through an outlet.

11. An apparatus for producing an annotation, with powder on a pattern piece, said apparatus comprising marking means comprising means for storing said powder; means for guiding said powder to an outlet; a toothed wheel rotatably mounted adjacent to a portion of said means for guiding said powder and partially defining a channel between said means for guiding said powder and said wheel, teeth of said wheel extending substantially into said channel; and means for rotating said wheel so that said teeth move said powder along said means for guiding said powder, means defining a support surface for supporting said workpiece, and means for moving said marking means and said support surface relative to one another along a course which outlines said annotation as powder is output through said outlet, said outlet having dimensions suitable to produce omnidirectional lines of sufficiently similar and small thickness to yield a legible annotation.

12. An apparatus as set forth in claim 11 wherein said means for rotating said wheel rotates said wheel at speeds coordinated with various marking speeds to regulate marking intensity.

13. An apparatus as set forth in claim 11 wherein said outlet is generally round.

14. An apparatus as set forth in claim 11 wherein said teeth extending into said channel have a length nearly equal to the depth of said channel and a thickness nearly equal to the width of said channel so that a tooth within said channel forms a movable barrier within said channel.

15. An apparatus as set forth in claim 14 further comprising another toothed wheel, which other wheel meshes with the first said wheel and protuberances, other than said teeth of said other wheel, attached to a face of said other wheel and extending into said means for storing said powder, which protuberance agitate said chalk when said other wheel rotates.

16. A marker for producing an inscription with powder on a workpiece, said marker co-operable with a mechanism for moving said marker and said workpiece relative to one another, said marker comprising:

grinding means for grinding powder from its solid form, said grinding means comprisng a grinding surface and engaging means including a flexible member which engages the grinding surface for dislodging powder from said grinding means.

17. A marker as set forth in claim 16 wherein said grinding means comprises a grinding wheel having teeth and a means for rotating said wheel, and said engaging means comprises a flexible wire which engages said teeth as said wheel rotates.

18. A marker as set forth in claim 17 wherein the cross-section of each of said teeth on said grinding wheel is triangular and said wire extends into a valley defined by an adjacent pair of said teeth.

19. A marker as set forth in claim 17 wherein said flexible wire extends into recesses defined by adjacent teeth to scrape powder lodged in said recesses.

20. A marker as set forth in claim 17 further comprising a housing for said grinding means, said wire being secured at one end in fixed relation to said housing, the other end of said wire engaging said teeth.

21. An apparatus for working on sheet material, said apparatus comprising:

marker means for marking said sheet material with powder, said marker means comprising grinding means for grinding said powder from its solid form and temporarily suspending it in air housing means for containing said temporarily suspended powder about said grinding means, guide means for directing said powder toward said sheet material, and air moving means for entraining said powder within said housing means immediately after being ground and while said powder is temporarily suspended in the air and transporting said powder through said guide means, means defining a support surface for supporting said sheet material, means for supporting said guide means adjacent to said support surface and moving said guide means and said support surface relative to one another in a manner which corresponds to the shape of an inscription as said marker means deposits powder on said sheet material to produce said inscription, and cutting means for cutting said sheet material, said means for supporting said guide means and moving said guide means relative to said support surface including means for supporting said cutting means and moving said cutting means and said support surface relative to one another, said guide means being fixed relative to said cutting means.

22. In an apparatus for working on sheet material, said apparatus comprising a cutter, means defining a support surface for supporting said sheet material and a means for moving said cutter and said support surface relative to one another to effect cutting, the improvement comprising:

rotatable grinding means for grinding powder from its solid form, said grinding means including a grinding surface, and engaging means for dislodging powder from said grinding means, said engaging means including a flexible member which engages the grinding surface as said grinding means rotates.

23. An apparatus for working on sheet material, said apparatus comprising:

marking means for marking said sheet material with powder, said marking means comprising grinding means for grinding powder from its solid form, means defining a support surface for supporting said sheet material, means for supporting said grinding means above said support surface to directly deposit said powder on said sheet material and moving said grinding means and said support surface relative to one another, cutting means for cutting said worksheet, and means for supporting said cutting means adjacent to said support surface.

24. An apparatus for working on sheet material, said apparatus comprising:

marking means for marking said sheet material with powder, said marking means comprising grinding means for grinding powder from its solid form, means defining a support surface for supporting said sheet material, means for supporting said grinding means above said support surface to directly deposit said powder on said sheet material and moving said grinding means and said support surface relative to one another, and cutting means for cutting said worksheet, said means for supporting said grinding means and moving said grinding means and said support surface relative to one another including means for moving said cutting means and said support surface relative to one another.

25. An apparatus for cutting and annotating a fabric worksheet, said apparatus comprising:

means defining a support surface for supporting said fabric worksheet, cutting means for cutting said fabric worksheet, means for grinding powder from its solid form and directly dispensing said ground powder to an outlet to mark said fabric supported on a said support surface, and means for moving said grinding means and said support surface relative to one another in a manner which corresponds to the shape of an annotation as powder is dispensed onto said fabric worksheet and for moving said cutting means and said support surface relative to one-another in a manner which corresponds to the shape of a pattern piece as said cutting means cuts said worksheet.

26. An apparatus for cutting and annotating a fabric worksheet, said apparatus comprising:

means defining a support surface for supporting said fabric worksheet, cutting means for cutting said fabric worksheet, means for dispensing a stream of powder onto said fabric worksheet to mark said worksheet, means for moving said dispensing means and said support surface relative to one another in a manner which corresponds to the shape of an annotation as said stream of powder is dispensed onto said fabric worksheet and for moving said cutting means and said support surface relative to one another in a manner which corresponds to the shape of a pattern piece as said cutting means cuts said worksheet, and means for varying the rate of flow of said stream of powder as it is dispensed onto said worksheet in accordance with the speed of said dispensing means relative to said supporting surface.

* * * * *